US007083134B2

(12) United States Patent
Alatalo et al.

(10) Patent No.: US 7,083,134 B2
(45) Date of Patent: Aug. 1, 2006

(54) YARN FEEDING DEVICE

(75) Inventors: Mikael Alatalo, Moelnlycke (SE); Lars Helge Gottfrid Tholander, Haverdal (SE)

(73) Assignee: IROPA AG, Baar (CH)

( * ) Notice: Subject to any disclaimer, the term of this patent is extended or adjusted under 35 U.S.C. 154(b) by 0 days.

(21) Appl. No.: 10/490,541

(22) PCT Filed: Sep. 24, 2002

(86) PCT No.: PCT/EP02/10700

§ 371 (c)(1),
(2), (4) Date: Oct. 18, 2004

(87) PCT Pub. No.: WO03/029121

PCT Pub. Date: Apr. 10, 2003

(65) Prior Publication Data

US 2005/0061903 A1 Mar. 24, 2005

(30) Foreign Application Priority Data

Sep. 24, 2001 (SE) ..... 0103196

(51) Int. Cl.
*B65H 51/20* (2006.01)

(52) U.S. Cl. ..... 242/364.4; 242/365.3; 242/365.6

(58) Field of Classification Search ..... 242/365.3, 242/365.7, 365.6, 364.4; 139/452
See application file for complete search history.

(56) References Cited

U.S. PATENT DOCUMENTS 4,116,397 A * 9/1978 Burgbacher ..... 242/364.9

(Continued)

FOREIGN PATENT DOCUMENTS

EP 0 327 973 A1 8/1989

(Continued)

OTHER PUBLICATIONS

U.S. Appl. No. 10/468,632, filed Feb. 13, 2002 as PCT Int'l. Application No. PCT/EP02/01512, Inventors: Egon Johansson et al.; including written description (7 pages) , claims (3 pages) and drawings (2 sheets).

*Primary Examiner*—Kathy Matecki
*Assistant Examiner*—William E. Dondero
(74) *Attorney, Agent, or Firm*—Flynn, Thiel, Boutell & Tanis, PC

(57) ABSTRACT

The invention relates to a yarn feeding device (F) for weaving or knitting machines whose winding element (W) is driven by an electric motor (M) controlled by an electronic speed control device (CU). According to the invention, the electric motor (M) is a synchronous motor, in particular, a permanent magnet (PM) motor with the speed control device (CU) provided for effecting a permanent vector control with the stator being sinusoidally acted upon. Continuously determined information pertaining to the relevant rotational position of the rotor (R) of the motor (M) is used in the speed control device (CU), which serves to perform permanent vector control, in order to adjust at least one predetermined rotational position (X1, X2) of the winding element (W).

16 Claims, 2 Drawing Sheets

U.S. PATENT DOCUMENTS

| | | | | | |
|---|---|---|---|---|---|
| 4,763,050 | A | * | 8/1988 | Ruppert | 318/254 |
| 4,814,677 | A | * | 3/1989 | Plunkett | 318/254 |
| 4,936,356 | A | * | 6/1990 | Ghiardo | 139/452 |
| 5,144,564 | A | * | 9/1992 | Naidu et al. | 318/721 |
| 5,351,724 | A | * | 10/1994 | Zenoni et al. | 139/452 |
| 6,356,048 | B1 | | 3/2002 | Zenoni et al. | |

FOREIGN PATENT DOCUMENTS

| | | | | |
|---|---|---|---|---|
| EP | 0 580 267 | A1 | | 1/1994 |
| EP | 1 052 766 | A2 | | 11/2000 |
| WO | WO 02/066353 | A1 | | 8/2002 |
| WO | WO 2004038907 | A1 | * | 5/2004 |

* cited by examiner

YARN FEEDING DEVICE

FIELD OF THE INVENTION

The invention relates to a yarn feeding device and more specifically to the use of an electric synchronous motor for controlling a yarn feeding device.

BACKGROUND OF THE INVENTION

The yarn feeding device known from EP 0 580 267 A1 comprises a pre-control device using the signals of a position sensor provided in the yarn feeding device in order to slowly drive the electric motor after switching off the electric motor by the speed control device until the winding element reaches a predetermined rotational position in relation to the housing. The control effort needed is considerable.

The yarn feeding device as known from EP 0 327 973 A (U.S. Pat. No. 4,936,356) is provided with a detector fixed to the housing which detector can be actuated by a transmitter rotating with the winding element in order to adjust the winding element with slow rotational speed into a predetermined position relative to the housing when the speed control device has to switch off the electric motor. The predetermined position of the winding element may be appropriate in order to facilitate threading of the yarn through the yarn feeding device.

U.S. Pat. No. 4,814,677 A generally discloses a field orientation control system of a permanent magnet motor operating by sinusoidal stator part actuation. The information on the momentary rotary position of the rotor is derived from measured stator voltages and stator currents. This is carried out without additional position sensors. The detected relative rotary positions of the rotor are used for the speed control and the torque control of the permanent magnet motor.

The so-called brushless DC motor (BLDC) known from EP 10 52 766 A2 (U.S. Pat. No. 6,356,048) is employed as the drive source for the winding element of a yarn feeding device. The motor is designed without sensors. A control system is provided for controlling the torque and/or the speed of the motor. The control system calculates the commutation switching points for the stator parts in six angled positions which are distant by a respective 60° without a position sensor. In this case the zero crossing points of the backwards acting electromotive force are determined which are induced in the stator windings by the rotation of the rotor magnets. In-between the six switching points, distributed about a full revolution, the position of the rotor remains unknown. The backwards acting electromotive force is effected according to a trapezoidal course. This motor drive control principle does not allow a sufficiently accurate position control and position observation of the winding element because only predetermined rotary positions of the rotor are detected.

SUMMARY OF THE INVENTION

It is an object of the invention to provide a yarn feeding device of the kind as disclosed herein which allows in a structurally simple and controllable fashion an accurate position control and/or position observation of the winding element in order to selectively and precisely reproducibly adjust a predetermined rotary position of the winding element which rotary position is needed for an auxiliary function of the yarn feeding device.

Additionally, this object can be achieved particularly expediently and simply by employing an electric synchronous motor for the control of the yarn feeding device, particularly a permanent magnet motor, which operates with permanent (continuous) stator vector control and sinusoidal stator actuation, in order to carry out the position control and/or position observation of the winding element in relation to the housing of the yarn feeding device, and to use for that purpose the information about the respective rotary position of the rotor which anyhow is needed for the permanent (continuous) stator vector control.

The speed device equipped with the microprocessor detects permanently (continuously) the relative rotary position of the vector of the rotor which position corresponds to the momentary rotary position of the rotor. This is carried out to permanently (continuously) rotate the stator vector generated by the sinusoidal actuation of the stator part such that the desired speed and/or the desired torque is gained substantially steplessly. The information on the momentary rotary position of the rotor or the rotor vector, respectively, is used to adjust the winding element into the at least one predetermined relative position in the housing by using the fixed structural correlation between the rotor, the shaft and the winding element. This relative position is useful to thread the yarn by means of an automatic threading device without further checking the rotary position of the winding element, or to adjust the winding element into a position in which a manual threading process can be carried out without problems. Additionally or alternatively, the information by which during the permanent vector control of the rotor rotation is followed can be used to measure the wound on yarn length. The capacity of the microprocessor is sufficient without problems for this additional function. No sophisticated additional control circuits are needed, and also no costly sensor assemblies.

The motor, expediently, is a permanent magnet motor which is available for fair costs and is efficient and takes up only minimal mounting space. Basically, however, also other types of synchronous motors may be used within the scope of this invention, like so-called reluctance motors, so even so-called "switched reluctance motors (SR)". In principle, even a so-called BLDC (brushless DC motor) could co-operate with the speed control device according to the invention.

In order to be able to permanently (continuously) and precisely follow the movement of the rotor, it is of advantage when the permanent magnets in the rotor are designed (e.g. formed), magnetised and/or configured (placed) such that the backward acting electromotive force induced by the rotor in the stator winding follows a sinusoidal course. With the help of the sinusoidal course the respective rotor rotary position can be calculated accurately which is of advantage for the permanent (continuous) vector control, and which is very suitable as a side product also for the position control and/or position observation of the winding element relative to the housing.

A calculating circuit is, expediently, contained in the speed control device, preferably in a microprocessor, which calculates the relative rotor rotary position with the help of the induced backwards oriented electromotive force. The electromotive force can be measured precisely in terms of its course and its magnitude.

Additionally, if expedient, at least one rotary position sensor may be provided and connected to the speed control device. The signal of this sensor may be used in order to build up a holding torque by means of the motor control and to retain the winding element at the predetermined rotary position relative to the housing despite an externally acting rotary force, and in order to retrieve the rotary position of the winding element or the rotor, respectively, during a restart of the motor.

Expediently, several relative rotary positions of the winding element within a 360° rotation of the winding element are programmed and can be selectively adjusted for correspondingly control stopping of the motor. That means that the winding element as well is stopped in the most suitable rotary position depending on the planned auxiliary function at the yarn feeding device. This relative rotary position can be selected completely arbitrarily.

It is expedient to place the stator part in a predetermined rotary position in the housing. By this measure each desired relative position of the winding element, as programmed, can be set in relation to the housing already during assembly of the yarn feeding device, without the necessity to carry out further programming.

By means of the determined permanent relative rotary position of the rotor during the vector control even the rotary travel of the winding element at least from the start to the end of a driving period can be measured without additional equipment parts, which is useful to precisely measure the wound on yarn length.

Alternatively, the yarn length may be measured in the same fashion even between selected points in time or selected different relative rotary positions of the rotor, respectively, by evaluating the information about the momentary rotor rotation angle for this additional function.

A predetermined relative rotary position of the winding element in relation to the housing may be a full yarn threading position in which an exit opening of the winding element is aligned with a threading path provided in the housing of the yarn feeding device. The on-board pneumatic threading device then may thread a new yarn without further interference by an operator.

Alternatively, the predetermined rotary position of the winding element in relation to the housing and adjustment by means of the vector control may be a semi-threading position in which an exit opening of the winding element is positioned outside of shielding housing parts such that no obstacles hinder the manual gripping of the yarn for knotting the yarn to yarn material already provided on the storage surface, or such that the winding element does not have to be rotated manually into a position beneficial to this auxiliary function.

An electronic yarn length measuring device can be supplied with the information on the rotor rotary positions during the vector control in order to derive precise information on the yarn consumption.

In the case that additionally a position sensor for the winding element is provided in the yarn feeding device, in order to signal at least one position or to confirm a position, respectively, then this position sensor may be used for generating an aligning holding torque by means of the motor and in co-action with the speed control device. The holding torque retains the winding elements in the adjusted rotor position even if external forces tend to further rotate the winding element. The motor control is apt to adapt automatically to the magnitude of the acting external force in order to hold the winding element stationary.

Expediently, the position sensor comprises permanent magnets distributed along the circumference of the winding element, and at least one detecting element fixed to the housing which responds to the passage of each permanent magnet. Preferably, a digitally operating Hall element is provided generating a digital signal whenever a permanent magnet is passing. However, particularly expedient is also an analog Hall sensor responding respectively to one pair of adjacent permanent magnets in order to precisely monitor even rotation ranges of the winding element.

BRIEF DESCRIPTION OF THE DRAWINGS

An embodiment of the invention will be explained with reference to the drawings wherein.

DETAILED DESCRIPTION

Figure 1:
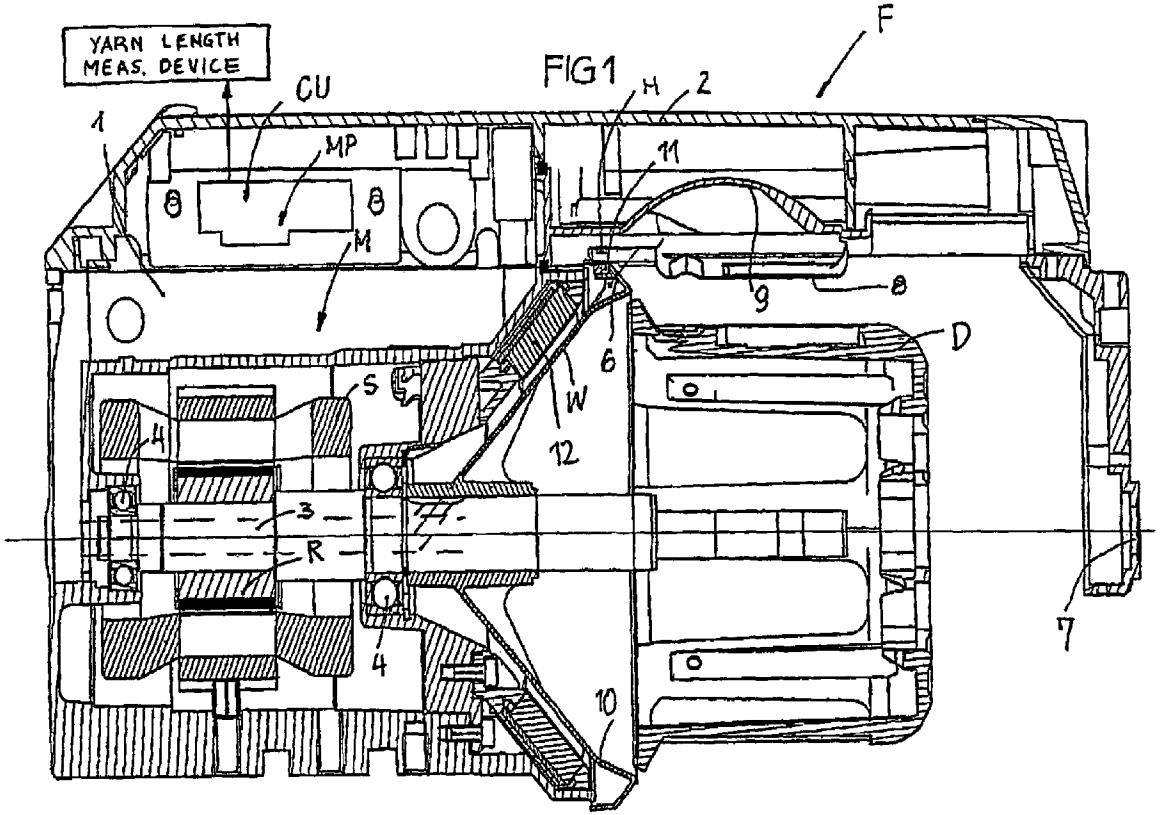
FIG. 1 is a longitudinal section of a yarn feeding device comprising a synchronous electric motor of a permanent magnet type as a driving source for a winding element.
Figure 2:
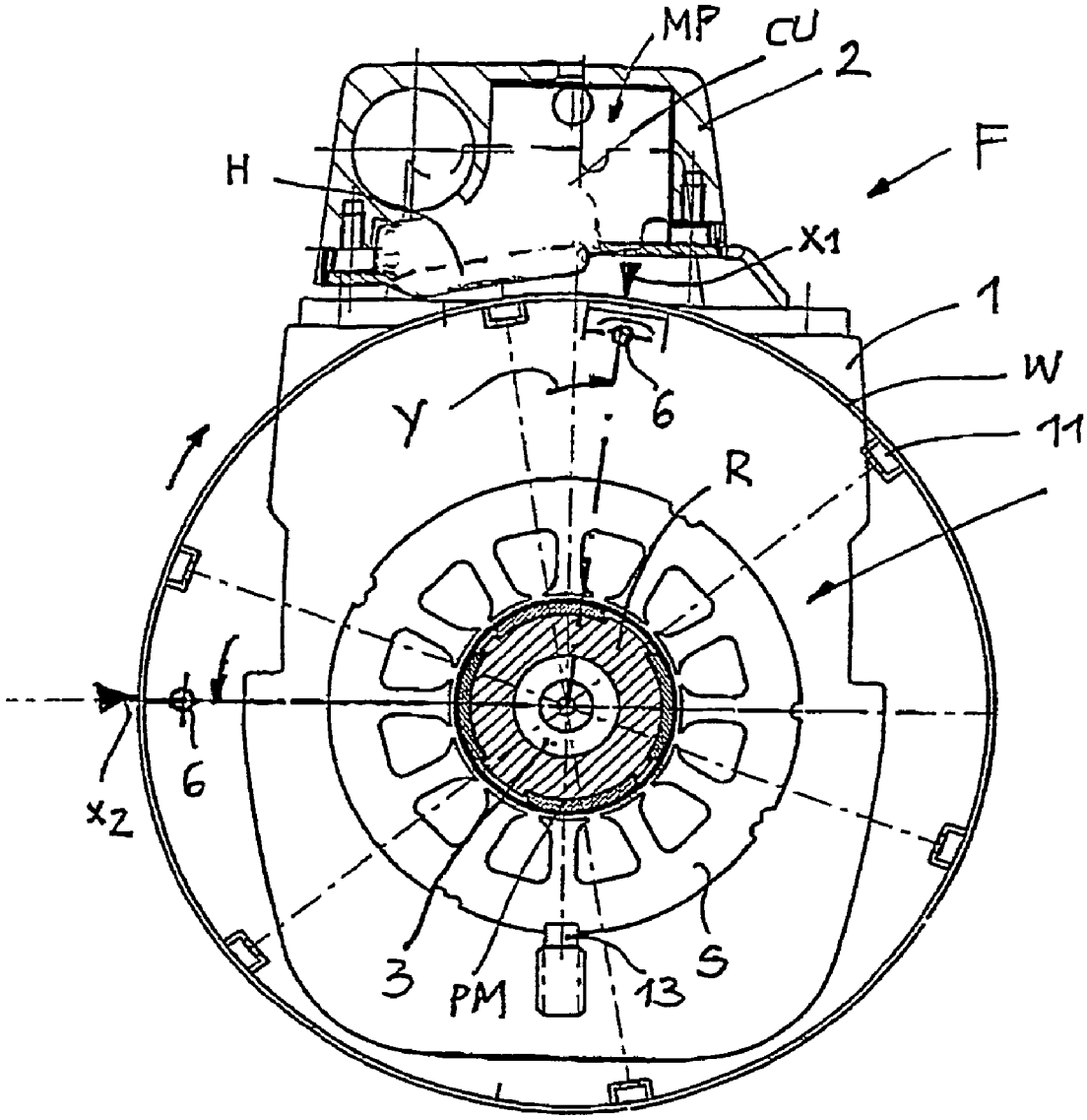
FIG. 2 is a cross-section of the yarn feeding device.

A yarn feeding device F as shown in FIG. 1 and FIG. 2 is a weft yarn feeding device for a weaving machine (not shown). However, the invention can be applied to a yarn feeding device for a knitting machine (not shown) as well, the yarn feeding device then having a rotary yarn storage drum defining a winding element.

The yarn feeding device F in FIGS. 1 and 2 comprises a housing 1 with a housing bracket 2 containing additional components. A hollow shaft 3 is rotatably supported in a bearing 4 in the housing 1. The shaft 3 stationarily supports by its free end a storage drum D which is positioned below the housing bracket 2. In order to prevent that the storage drum D from rotating together with the shaft 3 permanent magnets 12 are provided in the housing which magnetically co-act with not shown permanent magnets placed in the storage drum D.

A rotor R is provided on the shaft 3. The rotor co-acts with stator part S stationarily placed in the housing. The stator S is fixed by a positioning means 13 (FIGS. 1 and 2) in a predetermined rotary position.

An electric motor control device CU containing a microprocessor MP is contained in the housing bracket 2. The motor control device CU is connected for signal transmission to a yarn sensor assembly 8 and controls the speed, the torque and the rest periods of the electric motor M depending on the size of a yarn store formed by yarn windings on the storage drum D. Furthermore, a yarn threading path 9 is provided in the housing bracket 2 for co-action with a not shown, on-board pneumatic threading device in order to thread a new yarn entirely through the yarn feeding device. Furthermore, a withdrawal opening 7 for the yarn is placed at the housing bracket 2.

A winding element W having an exit opening 6 is fixed to the shaft 3. The relative rotary position of the exit opening with respect to the rotor R is structurally fixed. The winding element W may be formed as a funnel-shaped disk 10 containing a not shown winding tube terminating at the exit opening 6. At the winding element W permanent magnets 11 may be provided which are distributed along the circumference and which co-act with a detecting element H (for example, a digital or analog Hall sensor) stationarily provided in the housing bracket 2.

The electric motor M is an electric synchronous motor, preferably a permanent magnet motor (a so-called PM-motor). FIG. 2 illustrates the geometric distribution of permanent magnets PM in the rotor R and a schematic view of the stator part S (without stator windings provided therein).

With the help of the speed control device CU and the microprocessor MP a permanent vector control of the motor M is carried out, i.e., the rotary position of the rotor vector is determined continuously without sensors, and the stator vector is rotated by a corresponding current actuation continuously such that the desired speed and an optimum development of the torque result. The actuation of the stator windings is carried out sinusoidally. The permanent magnets PM in the rotor R are designed (formed), magnetised and/or configured (placed) such that, furthermore, forced by the function, the backwards oriented electromotive force in the stator windings resulting from the rotation of the rotor R in relation to the stator parts S will be induced with a sinusoidal course. With the help of the sinusoidal course of the induced electromotive force the rotary position of the rotor vector is continuously determined. The stator vector is rotated according to the determination by actuation of the stator part. The information about the momentary rotary position of the rotor vector or the rotor, respectively, in relation to the stator windings or the stator part S, respectively, and the housing, furthermore is used for the position control and/or the position observation of the winding element W.

Referring to FIG. 2 a predetermined rotary position X1 of the winding element W is a so-called full threading position in relation to the housing 1. In this full threading position the exit opening 6 of the winding element W is precisely aligned with the threading path 9 structurally integrated into the housing bracket 2. In this predetermined rotary position X1 the yarn while blown through the shaft 3 and out of the exit opening 6 is guided along the threading path 9 and finally is brought into the exit opening 7 without manual interference. However, a prerequisite for this function is that the winding element is stopped precisely at the predetermined rotary position X1 when the electric motor M is stopped. For adjusting this rotary position X1 now the permanently (continuously) present information on the rotary position of the rotor R in relation to the stator parts S or the housing, respectively, is used to precisely stop the winding element W at the predetermined rotary position X1 by means of the speed control device CU, which is useful in the event of a yarn breakage, as detected by not shown detectors.

In FIG. 2, furthermore, a further predetermined rotary position X2 is shown for the exit opening 6 of the winding element W. The rotary position X2 is predetermined such that the exit opening 6 is stopped offset by 90° in relation to the housing bracket 2, i.e. that the exit opening is not covered by any housing components hindering direct access.

In case that a not shown yarn detector detects a yarn breakage situation while yarn material is still present on the storage surface of the storage drum D, the winding element will be stopped in the rotary position X2 by means of the vector control of the electric motor M such that the then activated pneumatic threading device will present the blown-through yarn at an easily accessible position of the housing for being gripped by the operator. By a corresponding re-correlation of the signal generated by the yarn detectors the speed control device CU will have been informed beforehand in which of the two predetermined positions X1, X2 the yarn winding element W has to be adjusted for a certain operating condition.

The rotary position sensor H does not need to be used for this task. However, this sensor may assist in preventing undesired rotation of the winding element W when stopped at the respective position X1 or X2, respectively. This means that then the speed control device CU will build a holding torque in the one or the other sense of rotation in order to locally retain the winding element despite the influence of external forces (the yarn tension or the like). Furthermore, the rotary position sensor H may be used for determining the rotary position of the rotor R and at the same time of the winding element W in case of a new operation start-up and as rapidly as possible.

Furthermore, a yarn length measuring device can be interlinked with the speed control device CU in order to measure the length of the wound on yarn by means of the rotary travel Y of the winding element W.

The respective predetermined rotary position X1, X2 may be selected and adjusted arbitrarily, because the control permanently follows the movement of the rotor during operation of the motor and since the respective position information is present continuously. This means that neither the rotary positions X1, X2, nor further rotary positions of the winding element W as needed for other purposes have to be fixed beforehand either by the geometric relations between the stator S and the rotor R or by the geometric placement of the position sensor H. To the contrary any rotary positions can be freely adjusted or programmed, respectively, as they are best for the auxiliary functions of the yarn feeding device, e.g. for threading processes. The predetermined position X2 may be varied later by corresponding reprogramming, which is useful in a situation such as where several yarn feeding devices have to be placed close to each other at a weaving machine such that they might block the respective access to the position X2 in FIG. 2. In such a case the position X2 can be put to another location where comfortable access is possible for the operator despite the restriction by the several closely arranged yarn feeding devices.

Although a particular preferred embodiment of the invention has been disclosed in detail for illustrative purposes, it will be recognized that variations or modifications of the disclosed apparatus, including the rearrangement of parts, lie within the scope of the present invention.

The invention claimed is:

1. Yarn feeding device for weaving machines or knitting machines, the yarn feeding device comprising a housing in which a shaft provided with a winding element is rotatably supported, a storage surface for yarn windings formed by the winding element, sensor assemblies at least for scanning the yarn windings, an electric motor consisting of a stator part and a rotor which is connected to the shaft for rotating the winding element, and an electronic speed control device of the electric motor which electronic speed control device is connected for signal transmissions with the sensor assemblies and the electric motor, and a position control and position observation at least for adjusting the winding element by the electric motor into at least one predetermined rotary stop position in relation to the housing, wherein the electric motor is a synchronous motor controlled by the speed control device, the speed control device having a microprocessor for a permanent vector control of the electric motor by detecting the relative rotary position of a vector of the rotor to determine the relative rotary rotor position and by rotating a stator vector in relation to the detected vector of the rotor by sinusoidal stator actuation, and wherein the predetermined rotary stop position of the winding element is adjusted by stopping the electric motor by use of the permanently determined vector control information in the speed control device.

2. Yarn feeding device as in claim 1, wherein the electric motor is a permanent magnet motor containing magnetized and structured permanent magnets distributed in the rotor according to a predetermined geometry, and wherein the distribution, structure and magnetization of the permanent magnets are selected such that a sinusoidal course of backwards acting electromotive force is induced in the stator part by the relative rotor rotation.

3. Yarn feeding device as in claim 2, wherein the electric motor is a sensor-free permanent magnet motor, and wherein a calculation circuit is provided in the speed control device for permanently calculating the relative rotor rotary position with the help of indirect measurements of the induced electromotive force.

4. Yarn feeding device as in claim 1, wherein at least one rotary position sensor is provided in the yarn feeding device for detecting a predetermined rotary stop position either of the rotor or of the winding element, and wherein the rotary stop sensor is connected to the speed control device.

5. Yarn feeding device as in claim 4, wherein the rotary position sensor comprises permanent magnets distributed along the circumference of the winding element and at least one Hall sensor detection element fixed to the housing, which detection element either responds digitally to the passage of each permanent magnet or has an analog response to the relative rotary position of a respective pair of permanent magnets.

6. Yarn feeding device as in claim 1, wherein a plurality of predetermined relative rotary positions of the winding element is programmed within a 360° rotation in the speed control device.

7. Yarn feeding device as in claim 1, wherein a yarn length measuring device is interlinked with the speed control device for permanently transmitting information on the relative rotary position to the yarn length measuring device for measuring by means of the information on the relative rotary position of the rotor the rotation travel of the winding element representing a wound on yarn length on the storage surface either as fed between the start and the end of the driving period or between selected points in time or selected different relative rotary positions of the rotor.

8. Yarn feeding device as in claim 1, wherein one predetermined rotary stop position of the winding element is a relative rotor rotary position in which an exit opening of the winding element connected to the rotor is aligned with a threading path positioned in a stationary position in the housing of the yarn feeding device.

9. Yarn feeding device as in claim 1, wherein one predetermined rotary stop position of the winding element is a rotor rotary position where an exit opening of the winding element is stopped in relation to the housing in a semi-threading position where the exit opening is positioned at the side of housing parts obstructing a manual access from the outside to the exit opening.

10. A method of operating a yarn feeding device for weaving machines or knitting machines, the yarn feeding device having a winding element defining a storage surface for yarn windings and being disposed on a shaft that is rotatably supported in a housing, a sensor assembly adapted to scan the yarn windings, a synchronous electric motor with a stator fixed with respect to the housing and a rotor connected to the shaft for rotating the winding element, and an electronic speed control device connected for signal transmissions with the sensor assembly and the electric motor and adapted to monitor rotary position of the shaft and control the speed of the electric motor, the method comprising:

detecting a relative rotary position of a vector of the rotor to determine the rotary rotor position relative to the stator;

rotating a stator vector in relation to the detected vector of the rotor by sinusoidal stator actuation;

controlling the speed of the electric motor through continuous vector control of the electric motor; and stopping rotation of the shaft by controlling the electric motor to position the winding element in a predetermined rotary stop position in relation to the housing by use of the permanently determined vector control information in the speed control device.

11. The method of operating a yarn feeding device of claim 10, including determining the relative rotary rotor position by calculation based upon indirect measurements of induced electromotive force in the stator.

12. The method of operating a yarn feeding device of claim 10, including permanently transmitting information on the relative rotary rotor position to a yarn length measuring device.

13. A yarn feeding device comprising:

a winding element defining a storage surface for yarn windings and being rotatably supported in a housing;

a sensor assembly adapted to scan the yarn windings;

a synchronous electric motor with a stator fixed with respect to the housing and a rotor connected to rotate together with the winding element; and an electronic speed control device connected for signal transmissions with the sensor assembly and the electric motor and adapted to monitor the rotary position of the winding element and control the rotational speed of the electric motor, the electronic speed control device being adapted to detect a relative rotary position of a vector of the rotor to determine the relative rotary rotor position, rotate a stator vector in relation to the detected vector of the rotor by sinusoidal stator actuation, control rotational speed of the electric motor through continuous vector control of the electric motor, and stop rotation of the winding element at a predetermined rotary stop position in relation to the housing by controlling the electric motor by use of the continuously determined vector control information.

14. The yarn feeding device of claim 13, wherein the electric motor is sensor-free, and wherein the speed control device comprises a microprocessor adapted to calculate the relative rotor rotary position based upon indirect measurements of induced electromotive force in the stator.

15. The yarn feeding device of claim 13, wherein a threading path is positioned in a stationary position in the housing, an exit opening is disposed in the winding element, and the predetermined rotary stop position of the winding element corresponds to a relative rotor rotary position at which the exit opening of the winding element is aligned with the threading path.

16. The yarn feeding device of claim 13, wherein an exit opening is disposed in the winding element, and the predetermined rotary stop position of the winding element corresponds to a relative rotor rotary position at which the exit opening of the winding element is disposed in relation to the housing in a semi-threading position wherein the exit opening is positioned to the side of housing parts obstructing manual access from the outside to the exit opening.

* * * * *